US008806709B2

(12) United States Patent
Ulrich et al.

(10) Patent No.: US 8,806,709 B2
(45) Date of Patent: Aug. 19, 2014

(54) VACUUM SWEEPING MACHINE HAVING A SUCTION EXTRACTION SYSTEM FOR A SIDE BROOM

(71) Applicant: Hako GmbH, Bad Oldesloe (DE)

(72) Inventors: Bertram Ulrich, Luebeck (DE); Anatoliy Schmidt, Hamburg (DE); Carsten Protz, Altrenkrempe (DE)

(73) Assignee: Hako GmbH, Bad Oldesloe (DE)

( * ) Notice: Subject to any disclaimer, the term of this patent is extended or adjusted under 35 U.S.C. 154(b) by 0 days.

(21) Appl. No.: 13/941,790

(22) Filed: Jul. 15, 2013

(65) Prior Publication Data

US 2014/0026352 A1 Jan. 30, 2014

(30) Foreign Application Priority Data

Jul. 24, 2012 (EP) ..... 12177726

(51) Int. Cl.
*A47L 5/00* (2006.01)
*A47L 9/00* (2006.01)
*E01H 1/08* (2006.01)

(52) U.S. Cl.
CPC ..... *A47L 9/009* (2013.01); *E01H 1/0845* (2013.01)
USPC ..... 15/364; 15/366; 15/340.4

(58) Field of Classification Search
CPC ..... A47L 5/00; E01H 1/05; E01H 1/08
USPC ..... 15/364, 366, 340.4
IPC ..... A47L 5/00
See application file for complete search history.

(56) References Cited

U.S. PATENT DOCUMENTS 3,186,021 A 6/1965 Krier et al.

FOREIGN PATENT DOCUMENTS

DE 1256241 B 12/1967
DE 19715435 C2 2/2000

*Primary Examiner* — David Redding
(74) *Attorney, Agent, or Firm* — Harness, Dickey & Pierce, P.L.C.

(57) ABSTRACT

A vacuum sweeping machine having a chassis, which is configured for moving the vacuum sweeping machine over a surface to be cleaned, a sweeping roller, a suction extraction device, a side broom and a connecting line. The sweeping roller, which is driven in rotation, is mounted on the chassis and surrounded by the sweeping-roller housing. The sweeping roller extends along its rotational axis between a first and a second side wall of the sweeping-roller housing. The suction extraction device has a suction side that is connected to the sweeping-roller housing for the purpose of suction extraction of dust-laden air. The side broom, which is driven in rotation and mounted on the chassis, is surrounded by an enclosure. The connecting line is provided between the sweeping-roller housing and the enclosure. Coupling of the connecting line to the sweeping-roller housing is provided in one of the side walls.

7 Claims, 3 Drawing Sheets

VACUUM SWEEPING MACHINE HAVING A SUCTION EXTRACTION SYSTEM FOR A SIDE BROOM

CROSS-REFERENCE TO RELATED APPLICATIONS

Figure 1:
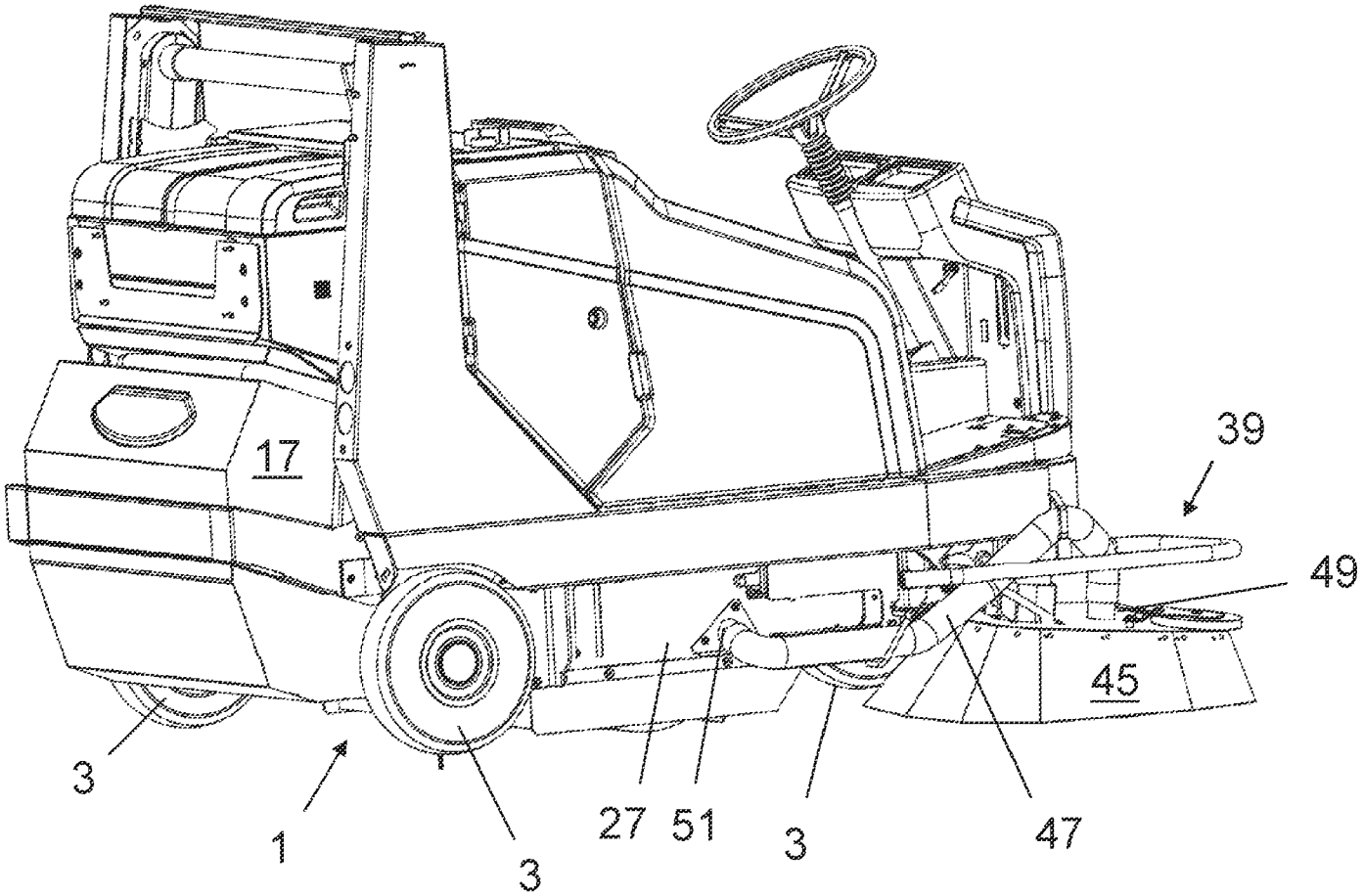

This application claims the benefit and priority of European Patent Application No. EP 12177726.2, filed Jul. 24, 2012. The entire disclosure of the above application is incorporated herein by reference.

FIELD

The present disclosure relates to a vacuum sweeping machine comprising a chassis for moving the vacuum sweeping machine over a surface to be cleaned, a sweeping roller, driven in rotation, which is mounted on the chassis and surrounded by a sweeping-roller housing, wherein the sweeping roller extends, along its rotational axis, between a first and a second side wall of the sweeping-roller housing, a suction extraction device, which, on the suction side, is connected to the sweeping-roller housing for the purpose of suction extraction of dust-laden air, and a side broom driven in rotation and mounted on the chassis.

BACKGROUND

Vacuum sweeping machines known from the prior art, such as DE 197 15 435 C2, have a chassis by means of which the machine can be moved over a surface to be cleaned, such as pavements, streets, public squares and the like. Mounted on the chassis is a driven sweeping device having brushes that move over the surface. Normally, such a sweeping device is formed as a sweeping roller which extends transversely in relation to the direction of travel parallel in relation to the surface and which is driven in rotation. The sweeping roller in this case is surrounded by a sweeping-roller housing, which is connected to a suction extraction device in order to suck up dust swirled up by the sweeping roller.

Frequently, in addition to the sweeping roller that is mounted on the chassis and extends over the width thereof and transversely in relation to the direction of travel, such sweeping machines are also provided with a side broom, which is mounted laterally on the chassis and by means of which peripheral regions of the surfaces to be cleaned that are not covered by the sweeping roller, for example curbstones, can be cleaned.

In order to reduce dust emissions at the side broom of sweeping machines, water spray jets or enclosures are additionally used. Spray jets are used predominantly in the cleaning of exterior spaces, whereas in the cleaning of interior spaces there is often the requirement that the surface to be cleaned is to remain dry. Enclosures are therefore used in some cases where requirements relating to air quality in enclosed spaces are more stringent. The present invention therefore relates to dry-operation, mechanical pick-up sweeping machines having a side broom.

Side-broom enclosures alone have only a slight effect on the reduction of dust emissions of a side broom. In order to operate them effectively, the air has to be sucked out of the enclosure, so that a negative pressure is created inside the enclosure. The dust-laden air must then be cleaned by means of a dust separator. In order to prevent the escape of dust, the suction extraction system in this case must deliver a sufficiently high volumetric flow rate of air from the outside to the inside, through the side-broom enclosure.

There are various technical ways of meeting this air volumetric flow rate requirement for the side-broom suction extraction system, which is in addition to the suction extraction system in the case of the sweeping roller. On the one hand, it is possible to install an additional blower, which sucks up the dust-laden air out of the side-broom enclosure, solely for the purpose of side-broom suction extraction, and cleans this air by means of an additional dust separator provided for this purpose. This solution requires a large amount of structural space, creates additional acquisition and operating costs and, for the operator, increases the maintenance work.

On the other hand, it is possible to use the already existing suction extraction device and the fine filter for dust-free operation of the sweeping roller and also for the side-broom enclosure. For this purpose, the sweeping-roller housing is connected to the side-broom enclosure via a suction line. The blower must then be dimensioned for the volumetric flow rate demand of both the sweeping-roller housing and the side-broom enclosure.

However, if such a machine having a larger-dimensioned blower is operated without side-broom suction extraction, then, unless additional modifications are made to the machine, the fine filter becomes loaded by an increased volumetric flow rate of dust-laden air. This leads to more rapid fouling, and consequently to shorter cleaning intervals, which result in more frequent interruption of the sweeping operation.

SUMMARY

Starting from the prior art, the object of the present disclosure is therefore to provide a vacuum sweeping machine, of the type described at the outset, in which the volumetric flow rate required for the suction extraction of dust at the side broom is provided in the most efficient manner possible.

One manner in which this object may be achieved by one or more of the following: surrounding the side broom by an enclosure, providing a connecting line between the sweeping-roller housing and the enclosure, and coupling of the connecting line to the sweeping-roller housing in one of the side walls.

This arrangement exploits the fact that the sweeping roller, possibly because of radially extending brush elements, has the effect of a radial fan, i.e. an air flow is generated radially outwards, and consequently a negative pressure is generated in the region of the end faces of the sweeping rollers, or in the outside end region. In particular, this effect can be achieved if the brushes are arranged in strips that are spaced apart from each other in the circumferential direction and extend axially parallel in relation to the longitudinal axis of the sweeping roller or in an inclined manner in relation thereto, wherein the strips can have portions that differ from each other in their inclination, i.e. have varying inclination. If the coupling of the connecting line to the sweeping-roller housing is then arranged in the region of the side wall that is adjacent to an end of the sweeping roller, the negative pressure generated by the rotating sweeping roller can be utilized to generate the additional air flow for the suction extraction of the air out of the enclosure of the side broom. In this way, it is not necessary to provide a larger-dimensioned suction extraction device on the vacuum sweeping machine.

Moreover, if a vacuum sweeping machine is to be additionally provided with a side broom, only a small amount of structural work is required for the suction extraction of dust at the side broom. All that is needed is for the coupling to be mounted in the side wall of the sweeping-roller housing. A vacuum sweeping machine can therefore also be easily retrofitted with an arrangement according to the invention. Conversely, demounting can also be easily effected by removal of the connecting line and closure of the coupling, without the need to modify the suction extraction device of the sweeping roller.

In certain examples, in which the sweeping roller has a cylindrical shape with two end faces that are at a distance from each other and extend perpendicularly in relation to the rotational axis, the coupling on the side wall overlaps with a projection of an end face onto the side wall, parallel to the rotational axis. It is thereby ensured that the coupling for the connecting line is arranged in immediate lateral proximity to the outside end region of the sweeping roller, in which the negative pressure is generated by the rotation of the latter, with the result that this negative pressure can also be used directly to generate the air flow away from the enclosure of the side broom. It is particularly preferred in this case if the coupling is arranged on the side wall, inside the projection, at a distance from the centre point of the projection of the end face onto the side wall.

Furthermore, the sweeping roller can have brushes that extend radially away from a central body, which extends along the rotational axis. In the case of such a structure, the coupling on the side wall can be arranged so as to directly adjoin the projection of an end face of the central body onto the side wall or so as to overlap therewith, in which case, preferably, so as to overlap only partially. This then enables the coupling to be arranged next to the radially innermost portion of the brushes, in which there is the greatest negative pressure, with the result that an air flow can thus be generated in the connecting line in a particularly effective manner.

The side broom can be driven in rotation about a rotational axis extending in an inclined manner in relation to the surface to be cleaned, preferably at an angle of between 75° and 90°, wherein the connecting line is mounted on a wall portion of the enclosure through which the rotational axis extends.

Finally, the suction extraction device of the vacuum sweeping machine can have a fan, wherein a filter is arranged between the fan and the sweeping-roller housing.

DRAWINGS

Figure 2:
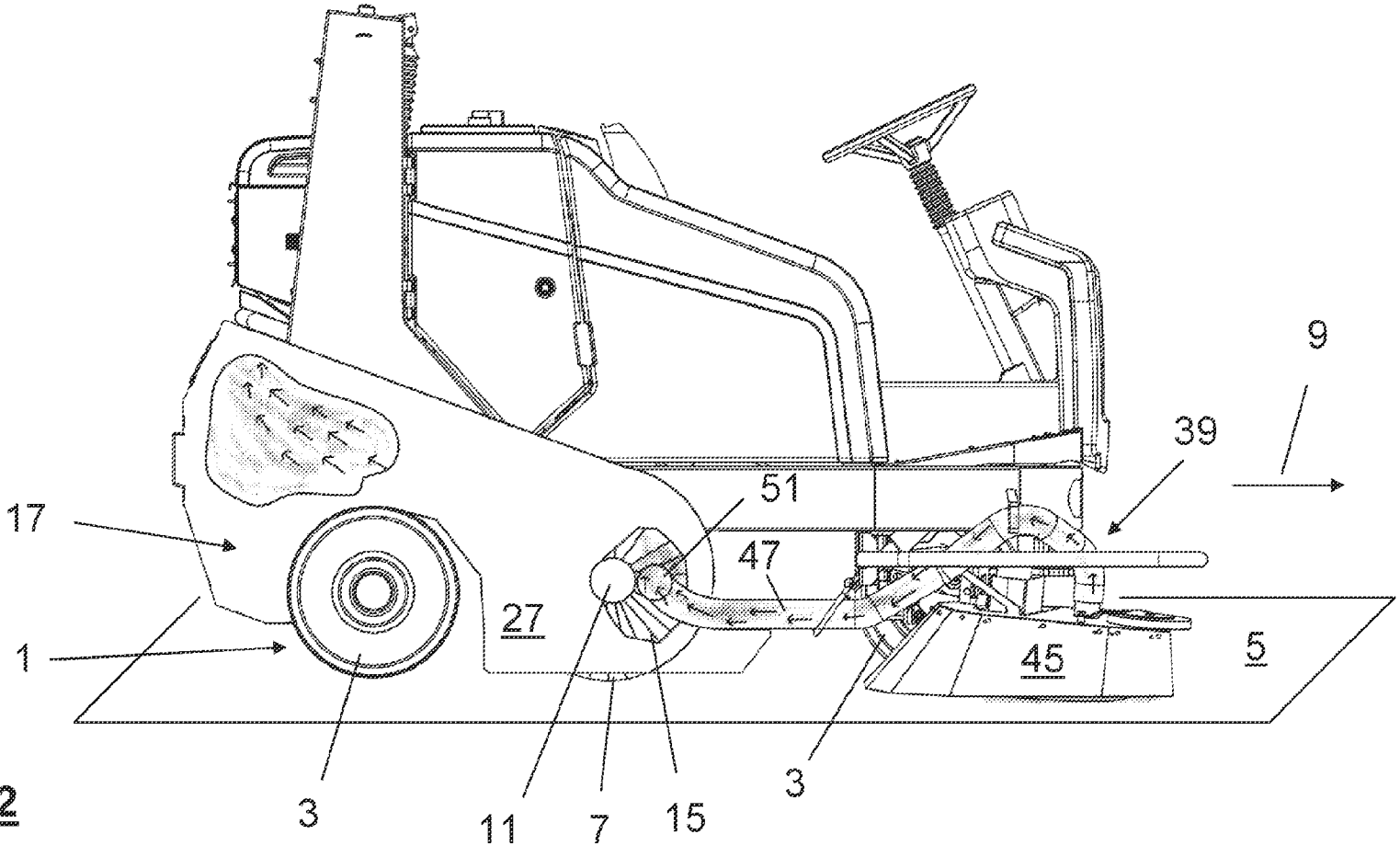
Figure 4:
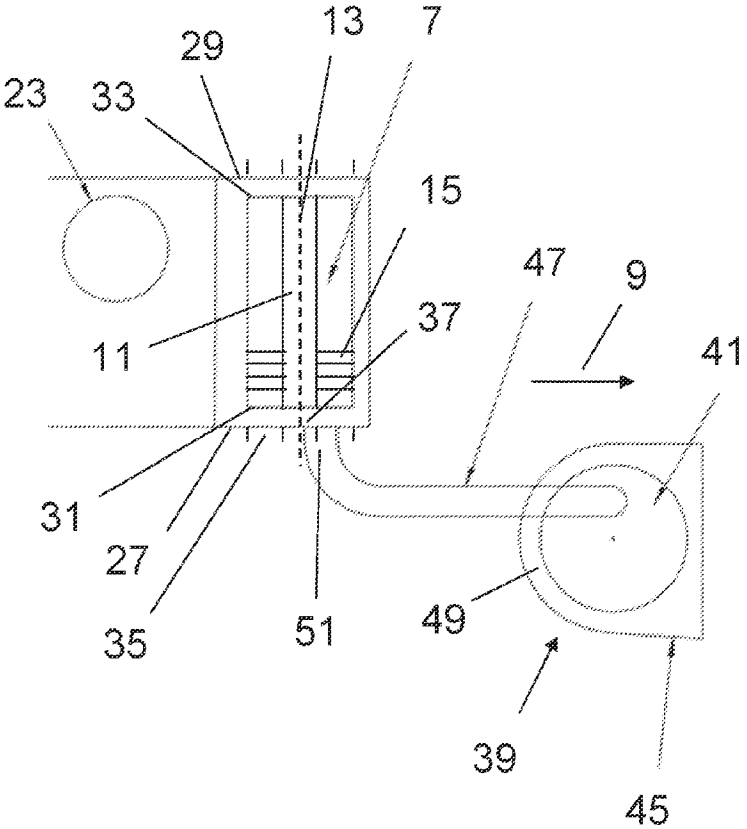
Figure 3:
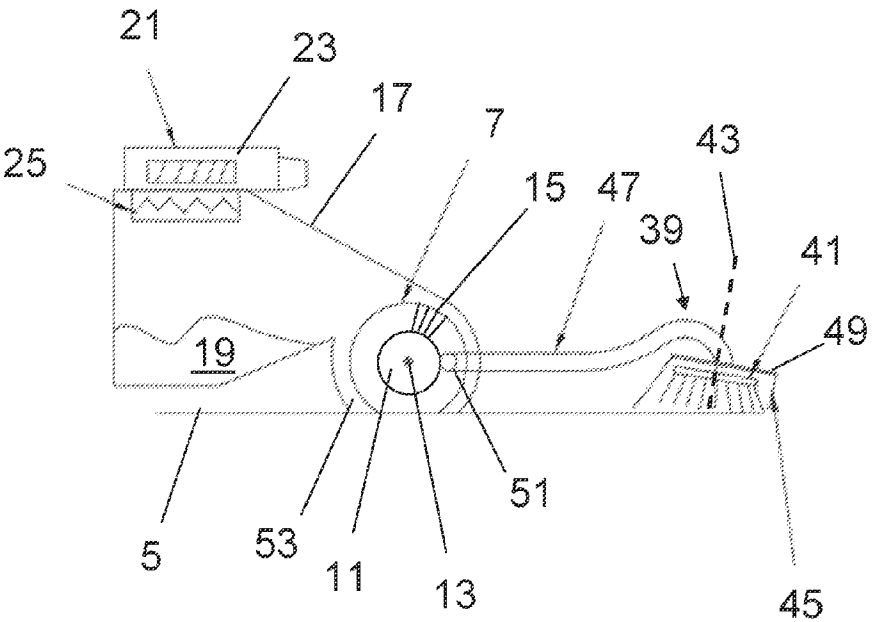

The present disclosure is explained in the following on the basis of a drawing representing merely a preferred embodiment, wherein FIG. 1 is a side perspective representation of a vacuum sweeping machine constructed in accordance with the teachings of the present disclosure, FIG. 2 is a first side view of the vacuum sweeping machine of FIG. 1, with partially opened sweeping-roller housing, FIG. 3 is a representation from the side of the arrangement consisting of sweeping roller, sweeping-roller housing, suction extraction device and side broom, in the case of the vacuum sweeping machine of FIG. 1, and FIG. 4 is a top view of the structure from FIG. 3, with a second arrangement of the coupling of the connecting line, differing from that of FIG. 3.

DETAILED DESCRIPTION

With reference to FIGS. 1 and 2 of the drawings, a vacuum sweeping machine constructed in accordance with the teachings of the present disclosure is illustrated. The vacuum sweeping machine can be a ride-on machine, and has a chassis 1 having wheels 3, with the result that the vacuum sweeping machine, with the user seated thereon, can travel over a surface 5 to be cleaned, such as, for example, a pavement, a street or a public square. It is also conceivable, however, for the vacuum sweeping machine to be formed in such a manner that a user walks behind the machine, with the result that the invention is not limited to ride-on machines.

It is furthermore shown in the figures that the vacuum sweeping machine has a sweeping roller 7 of cylindrical shape, which is driven in rotation and mounted on the chassis 1, and which extends parallelwise in relation to the surface 5 and substantially perpendicularly in relation to a main direction of motion 9, along which the vacuum sweeping machine moves by means of the chassis 1. The sweeping roller 7 in this case is in contact with the surface 5, with the result that dirt present on the surface 5 is thrown up by the rotation of the sweeping roller 7.

As can be seen from, in particular, FIG. 3, in particular example provided, the sweeping roller 7 is formed in such a manner that it has a central body 11, which extends along the rotational axis 13 and on which brushes 15 are mounted that extend radially in relation to the rotational axis 13. The brushes 15 can be arranged in strips, which are spaced apart from each other in the circumferential direction of the sweeping roller 7 and extend axially parallelwise in relation to the rotational axis 13 of the sweeping roller 7 or in an inclined manner in relation thereto, wherein the strips can have portions that differ from each other in their inclination in relation to the rotational axis 13, i.e. have varying inclination. Other structures are also conceivable, however, wherein the sweeping roller 7 preferably has elements extending radially from the rotational axis 13.

The sweeping roller 7 is surrounded by a sweeping-roller housing 17, which, moreover, in the rear part, has a receiving region 19 for coarse dirt, and has a suction extraction device 21. The suction extraction device 21 comprises a fan 23, which is preceded on the suction side by a filter 25, with the result that the filter 25 is located between the fan 23 and the sweeping-roller housing 17, and the suction extraction device 21 is connected, on the suction side, to the sweeping-roller housing 17 for the purpose of suction extraction of dust-laden air. Accordingly, by means of the suction extraction device 21, an air flow can be generated in the sweeping-roller housing 17, from the sweeping roller 7 towards a pressure side of the fan 23.

As can be seen from, in particular, FIG. 4, the sweeping roller 7 extends between a first side wall 27 and a second side wall 29 of the sweeping-roller housing 17. In this case, a first end face 31, which extends perpendicularly in relation to the rotational axis 13, faces towards the first side wall 27, while a second end face 33, likewise extending perpendicularly in relation to the rotational axis 13, faces towards the second side wall 29. The outer circumference of the sweeping roller 7 defines a projection 35, parallel to the rotational axis 13, onto the first side wall and, analogously, the outer circumference of the central body 11 of the sweeping roller 7 likewise defines a projection 37, parallel to the rotational axis 13, onto the first side wall 27. The outer edges of these projections 35, 37 are each indicated in FIG. 4.

As additionally shown by the figures, the embodiment of the vacuum sweeping machine is provided with a side-broom arrangement 39 which has a side broom 41 that is driven in rotation about a rotational axis 43 that, in this preferred embodiment, extends at an angle of between 75° and 90° to the surface 5 to be cleaned, and the brushes of which face towards the surface 5 to be cleaned. Furthermore, the side-broom arrangement 39 has an enclosure 45, which substantially completely surrounds the side broom 41 and is open only towards the surface 5. The side-broom arrangement 39 serves to clean peripheral regions of the surface 5 that cannot be reached by the sweeping roller 7, such as, for example, regions next to curbstones.

The enclosure 45 of the side-broom arrangement 39 is connected to the sweeping-roller housing 17 via a connecting line 47. One end of the connecting line 47 is in this case coupled to a wall portion 49 of the enclosure 45, through which the rotational axis 43 extends that, here, extends substantially perpendicularly in relation to the rotational axis 43 of the side broom 41. The housing-side end of the connecting line 47 has a coupling 51, which is located inside the projection 35, parallel to the rotational axis 13, of the first end face 31 of the sweeping roller 7 onto the first side wall 27 (see FIG. 4), with the result that the coupling 51 overlaps with the projection 35 of the end face 31 of the sweeping roller 7 onto the first side wall 27, parallel to the rotational axis 13. While in the case of the arrangement according to FIG. 3 the coupling 51 is arranged so as to directly adjoin the projection 37 of the end face of the central body 11, in the case of the arrangement according to FIG. 4 the coupling 51 partially overlaps with the projection 37 of the central body 11 onto the first side wall 27. In both cases, the coupling 51 is located, in the radial direction of the sweeping roller 7, in the region of the inner ends of the brushes 15 of the sweeping roller 7, and is therefore arranged at a distance from the centre point of the projections 35, 37 onto the first side wall 27.

When the vacuum sweeping machine represented is in operation, both the sweeping roller 7 and the side broom 41 are driven in rotation. In addition, the fan 23 is in operation, with the result that air is drawn through the filter 25 from the opening 53 of the sweeping-roller housing 17 that faces towards the ground surface 5 and is discharged outwards. Dirt thrown up by the sweeping roller 7 and its brushes 15 passes into the inside of the sweeping-roller housing 17, wherein coarse dirt is deposited in the receiver 19, while fine dust is caught in the filter 25.

Owing to the rotary motion of the sweeping roller 7 about the rotational axis 13, the sweeping roller also acts like a radial fan, in which a negative pressure is formed adjacent to the rotational axis 13, or at the outer circumferential wall of the central body 11, since air is conveyed radially outwards by the brushes 15. Since the coupling 51 of the connecting line 47 is arranged such that it just adjoins the projection 37 of the central body 11 onto the first side wall 27, negative pressure generated by the sweeping roller 7 is routed by this coupling to an air flow through the connecting line 47, away from the enclosure 45 of the side broom 41. Owing to this air flow, dust swirled up by the side broom 41 is drawn into the sweeping-roller housing 17 through the connecting line 47, and this dust is prevented from emerging from the enclosure 45 to the outside.

It is not necessary in this case for a separate blower arrangement, having an associated filter, to be provided for suction extraction of dust from the enclosure 45. Instead, even if a retrofit is desired, a correspondingly arranged coupling 51 can be provided on the sweeping-roller housing 17, in the region of the first side wall 27. In the same way, the side-broom arrangement 39, or only its enclosure 45, can be easily demounted, without the need to make modifications to the suction extraction device 21, since the volumetric flow rate required for the suction extraction at the side broom 41 is generated substantially by the sweeping roller 7.

What is claimed is:

1. A vacuum sweeping machine having a chassis for moving the vacuum sweeping machine over a surface to be cleaned, the vacuum sweeping machine comprising:

a sweeping roller, driven in rotation, which is mounted on the chassis and surrounded by a sweeping-roller housing, wherein the sweeping roller extends, along its rotational axis between a first and a second side wall of the sweeping-roller housing, a suction extraction device having a suction side that is connected to the sweeping-roller housing for the purpose of suction extraction of dust-laden air, and a side broom driven in rotation and mounted on the chassis, wherein the side broom is surrounded by an enclosure, wherein a connecting line is provided between the sweeping-roller housing and the enclosure, and wherein a coupling of the connecting line to the sweeping-roller housing is provided in one of the side walls.

2. The vacuum sweeping machine according to claim 1, wherein the sweeping roller has a cylindrical shape with two end faces that are at a distance from each other and extend perpendicularly in relation to the rotational axis, and wherein the coupling on the side wall overlaps with a projection of the end face onto the side wall, parallel to the rotational axis.

3. The vacuum sweeping machine according to claim 2, wherein the coupling is arranged on the side wall, at a distance from the centre point of the projection of the end face onto the side wall.

4. The vacuum sweeping machine according to claim 1, wherein the sweeping roller has brushes that extend radially away from a central body, which extends along the rotational axis.

5. The vacuum sweeping machine according to claim 4, wherein the coupling on the side wall is arranged so as to directly adjoin the projection of an end face of the central body onto the side wall or so as to overlap therewith.

6. The vacuum sweeping machine according to claim 1, wherein the side broom is driven in rotation about a rotational axis extending in an inclined manner in relation to the surface to be cleaned, preferably at an angle of between 75° and 90°, and wherein the connecting line is mounted on a wall portion of the enclosure through which the rotational axis extends.

7. The vacuum sweeping machine according to claim 1, wherein the suction extraction device has a fan, wherein a filter is arranged between the fan and the sweeping-roller housing.

* * * * *